United States Patent [19]

Dallaire et al.

[11] Patent Number: 4,512,582

[45] Date of Patent: Apr. 23, 1985

[54] RING PUZZLE

[76] Inventors: Rémy Dallaire, 461 St. Isidore St. P.O. Box 95, Lac à la Croix, Canada, G0W 1WO; Claude Larouche, 402 Desnoyers St. Apt. 8, Beauport, Canada, G1E 2N3

[21] Appl. No.: 606,691

[22] Filed: May 3, 1984

[51] Int. Cl.[3] ..... A63F 9/08

[52] U.S. Cl. ..... 273/158

[58] Field of Search ..... 273/156, 158

[56] References Cited

U.S. PATENT DOCUMENTS 2,993,253 8/1961 Kranzusch ..... 273/158

FOREIGN PATENT DOCUMENTS 124334 3/1910 Canada .
1083623 8/1980 Canada .
1172588 10/1958 France ..... 273/158
18840 12/1907 United Kingdom ..... 273/158

*Primary Examiner*—Anton O. Oechsle

[57] ABSTRACT

The puzzle is of the type comprising a number of individual rings, each of which is loosely connected to one end of a short post, with all the posts being in turn movably anchored at their other ends in a common base member. An elongated closed loop straddles the post and passes through the rings in a uniform manner. To solve the puzzle, that is to remove the loop, a number of precise steps is required. These steps need to be repeated in reverse to replace the loop. In accordance with the invention, each post is made of two parts, namely: a rod and a cap. The cap has a slot opening through three sides for the transverse insertion of the ring into the cap slot, with the ring protruding from two opposite sides. The cap further has a blind bore which extends across the slot opening at the third side. When the rod is inserted into the blind bore, it not only carries the cap and the ring but also locks the ring within the cap slot.

6 Claims, 16 Drawing Figures

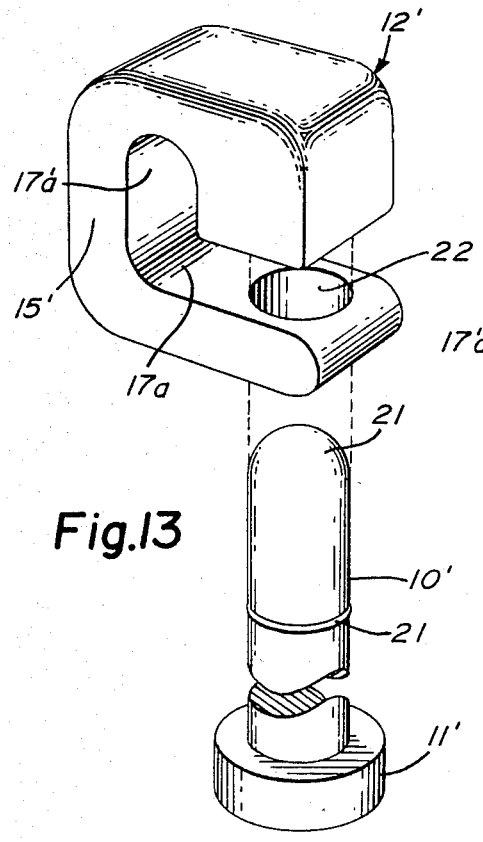
Fig.13
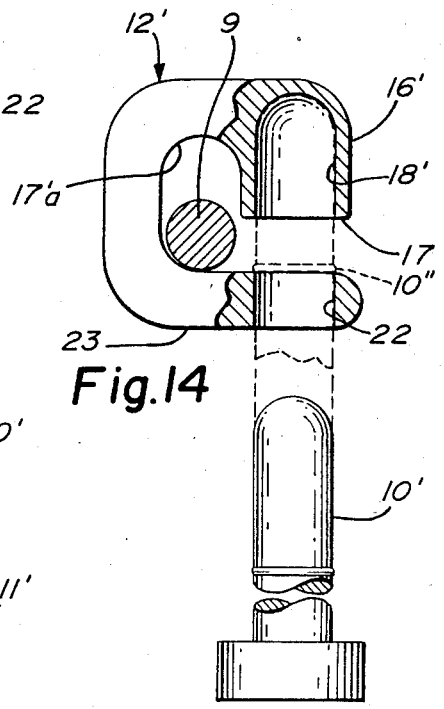
Fig.14
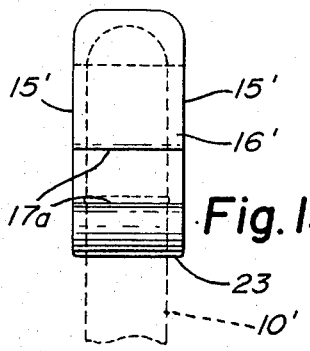
Fig. 15
Fig.16
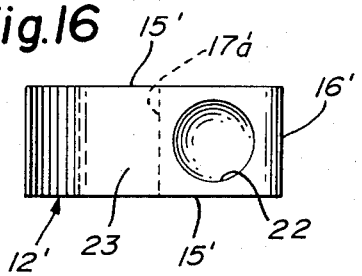

RING PUZZLE

FIELD OF THE INVENTION

The present invention relates to a ring puzzle of the type wherein a plurality of post-like members are movably anchored at one end to a common base member, while their opposite ends carry a like plurality of articulated ring-like members, there being provided an elongated closed loop member in interlocking engagement with respect to pairs of post-like members and ring-like members, so that the loop member can normally be disengaged from the post-like and ring-like members only by a series of prescribed manipulations of all of said members.

BACKGROUND OF THE INVENTION

Ring puzzles of this type have been known for a long time. Canadian Pat. No. 1,083,623 dated Aug. 12, 1980 to Claude Touchette and entitled: "RING PUZZLE" describes such an arrangement. However, they are expensive to manufacture, since each post-like member must be not only attached to a common base but also attached to the ring, requiring individual bending of the wire or rod around the associated ring to form an eyelet for loose connection of the ring to the post. Also, the previously-known ring puzzles lack in aesthetic value.

SUMMARY OF THE INVENTION

The puzzle ring of the invention is characterized by the fact that each post is made of two parts: namely: a rod and a cap. The cap has a slot opening through three sides for the transverse insertion of the ring into the cap slot, such that the ring will protrude from opposite two sides of the cap. The cap further has a blind bore for receiving the end of the rod with said blind bore intersecting the slot at the third side, so as to lock the ring within the cap slot.

BRIEF DESCRIPTION OF THE DRAWINGS

FIG. 13 is an exploded perspective view, partially cut away, of the cap and rod assembly in accordance with a second embodiment:

FIG. 14 is a side elevation of the embodiment of FIG. 13, partially in section and also showing a ring inserted in the slot and shown in cross-section;

FIG. 15 is an end elevation of the cap of FIG. 13; and

FIG. 16 is a bottom plan view of the cap of FIG. 13.

In the drawings, like reference characters indicate like elements throughout.

DETAILED DESCRIPTION OF THE PREFERRED EMBODIMENTS

Figure 1:
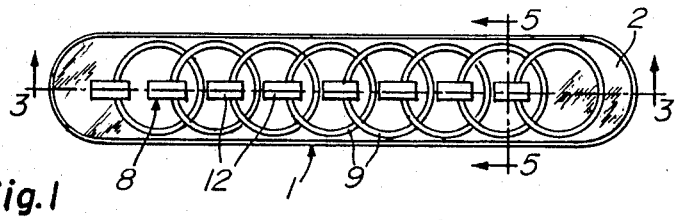
FIG. 1 is a top plan view of the puzzle ring of the puzzle ring of the invention.
Figure 2:
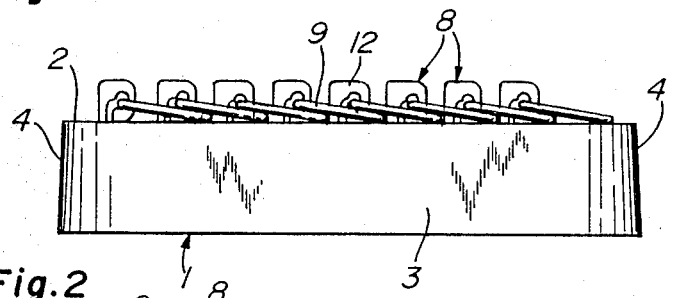
FIG. 2 is a side elevation.
Figure 3:
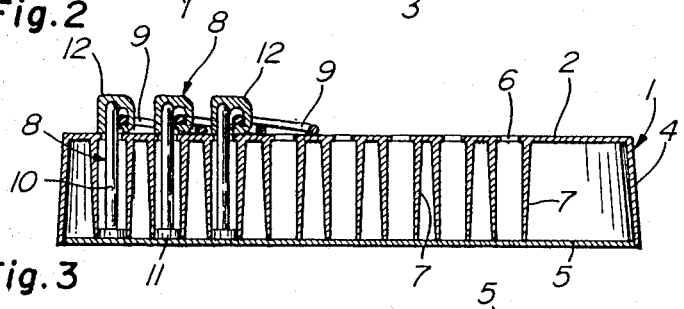
FIG. 3 is a longitudinal section along line 3—3 of FIG. 1.
Figure 4:
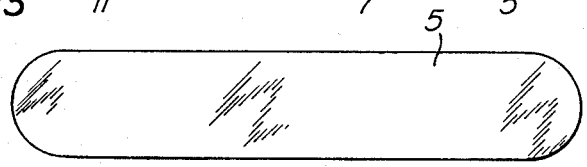
FIG. 4 is a bottom plan view.
Figure 5:
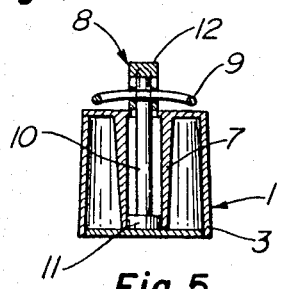
FIG. 5 is a cross-section along line 5—5 of FIG. 1.
Figure 6:
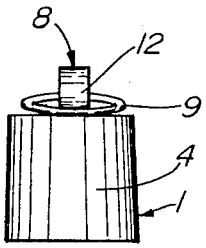
FIG. 6 is an end view.
Figure 7:
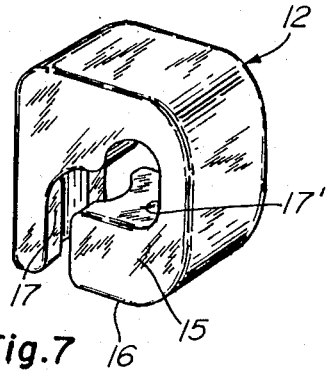
FIG. 7 is a perspective view of the cap in accordance with the first embodiment.
Figure 9:
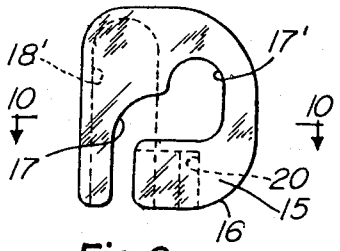
FIG. 9 is a side elevation of the cap of FIG. 7.
Figure 10:
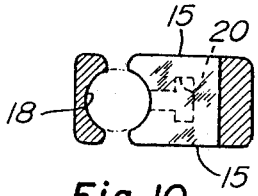
FIG. 10 is a cross-section, taken along line 10—10 of FIG. 9.
Figure 8:
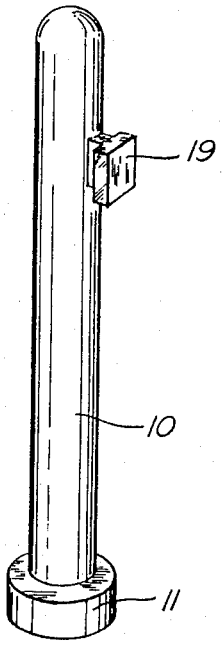
FIG. 8 is a perspective view of the rod adapted to be fitted within the cap of FIG. 7.

The puzzle ring includes a base member, generally indicated at 1, of elongated shape and including a top 2, longitudinal walls 3 and walls 4 forming an open bottom adapted to be closed by a cover plate 5. A number of openings 6 are made in the top 2 in longitudinal alignment, and each opening 6 opens within a cylinder 7 fixed to the top 2 and extending downwardly to contact cover plate 5. A plurality of post-like members 8 are loosely anchored to the common base member 3 and each carries a ring member 9.

In accordance with the invention, each post-like member 8 is formed by a straight rod 10 inserted through opening 6 of the top 2 and provided at its lower end with a stop means consisting of a washer 11, having a sliding fit within the cylinder 7, such that the rod 10 can be moved upwardly to a limit position in which the washer 11 abuts against the underface of top 2. The rod 10 is longer than the height of the base member 1 and, therefore, protrudes from the top 2. This protruding end is inserted within and retained in a cap member 12, which serves as a connection means between the ring 9 and the post-like member 8.

Figure 11:
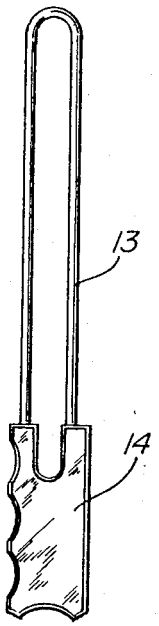
FIG. 11 is a side elevation of the loop member.
Figure 12:
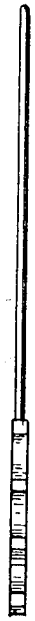
FIG. 12 is an end elevation of the loop member.

FIGS. 11 and 12 show the loop-like member 13 having a handle 14 at one end with the loop-like member 13 adapted to be inserted through the various rings 9, while straddling the caps 12. The cap in accordance with the first embodiment of each post-like member, and shown in FIGS. 7 to 10, includes a one-piece molded body confining a pair of opposite sides 15 and a third side 16.

A slot 17 is made in the cap body 12. This slot 17 opens not only at the opposite sides 15 but also at the third side 16. Therefore, a ring 9 can be reinserted within the cap slot 17, so that it will engage the inner end portion 17' of the slot 17. The cap 12 furthermore has a blind bore 18, of cylindrical shape and of a diameter to have a sliding and tight fit with the extremity of rod 10 opposite washer 11. This blind bore 18 intersects a portion of the slot 17 opening at the third side 16 of cap 12. Therefore, when the rod 10 is inserted within the blind bore 18 and adhered therein by an adhesive or the like, the ring 9 is locked in position within the portion 17' of the cap, and this cap furthermore forms a connection between the ring and the rod 10.

In order to prevent disengagement of the cap 12 from rod 10 due to possibly rough handling of the game device, the upper end portion of rod 10 is provided with a key 19, of T-shape cross-section, engageable with a similarly-shaped keyway 20 formed in the bottom of the cap 12 and opening at the third side 16.

From the foregoing, it will be seen that it is very easy to assemble the various parts of the invention. With the base plate 5 removed, the rods 10 are first assembled with the base member 1 by insertion of the respective rods through the holes 6. Each ring 9 is inserted within the slot 17 of its associated cap 12 and, thereafter, the cap 12 is fitted onto the protruding end of the rod 10. The base plate 5 is adhered to the lower edge of the walls 3 and 4, any time after insertion of the rods 10 within the cylinder 7 and through opening 6. The resulting puzzle assembly also is characterized by the fact that it has an aesthetic appearance and, furthermore, that it is devoid of any sharp edges liable to injure the users, especially when they are children.

FIGS. 13 to 16 show another embodiment of the post-like assembly. In this embodiment, each post-like member 8 is formed by two separate pieces, namely: a rod member 10' and a cap member 12'. Rod member 10' is straight and cylindrical and is provided with the washer 11' at one end, while its other end is provided with an annular protuberance 21 just inwardly of its free rounded end 21.

Cap member 12' has a ring-receiving slot 17*a* which opens at opposite sides 15' of the body of the cap and also at a third side 16'. Therefore, the ring member 9 can be freely inserted within the slot 17*a* into the inner portion 17'*a* same, to be freely rotatable within said inner portion and with the ring extending from the cap member 12' through the two opposite sides 15'. The cap 12' is furthermore provided with a blind bore 18' which intersects the slot opening at the third side 16'. However, in this embodiment, contrary to the the first embodiment wherein the blind bore opens to the exterior at the side 16 through which the slot 17 opens, blind bore 18' is in alignment with a through bore 22 opening at a fourth side 23 of the cap member 12. With this arrangement, when the rod 10' is inserted within the bores 18', 22, the two legs of the cap are completely locked to the rod 10'. Furthermore, the protuberance 21 overlies the through bore 22, as shown in dotted line in FIG. 14, preventing accidental removal of the rod 10' from the cap 12'. This arrangement is more secure than the embodiment of FIGS. 7 to 10, and furthermore, eliminates the requirements for the T-shape key 19 and keyway 20.

What we claim is:

1. In a puzzle having a plurality of post-like members and a plurality of ring-like members, said ring-like members being articulately attached adjacent the corresponding ends of respective ones of said post-like members, and an elongated closed loop-like member in interlocking engagement with the respective pairs of said post-like and ring-like members, so that the loop-like members can normally be disengaged from said post-like and ring-like members only by a series of prescribed manipulations of all of said members, said post-like members each having an opposite end movably anchored to a common base member, each post-like member being made of two parts, namely: a rod defining said corresponding end and a cap member, said cap member having a slot opening through three sides for the transverse insertion of a ring-like member into the cap slot with the ring-like member protruding from opposite two sides of said cap member, said cap member further having a blind bore extending across the third side of said cap slot, said blind bore receiving said corresponding end of said rod, whereby said rod is attached to said cap member and locks said ring within said cap slot.

2. In a ring puzzle as defined in claim 1, wherein said blind bore opens to the exterior of said cap at said third side.

3. In a ring puzzle as defined in claim 2, wherein said rod has a key member protruding laterally therefrom adjacent its corresponding end, and said cap member has a keyway slot for receiving said keyway member, said keyway opening at said third side adjacent the ring-receiving portion of said slot.

4. In a ring puzzle as defined in claim 1, wherein said blind bore opens at the exterior of said cap member at a fourth side of said cap member.

5. In a ring puzzle as claimed in claim 4, wherein said cap slot extends between two legs of said cap member, said blind bore formed in one of said legs and a through bore being formed in the other of said legs in register with said blind bore, said corresponding end of said rod being fitted within said through bore and blind bore.

6. In a ring puzzle as claimed in claim 5, further including an annular protuberance formed on the corresponding end of said rod, said protuberance overlying said through bore within said slot when said rod is inserted within the bores of said cap member.

* * * * *